US007110500B2

(12) United States Patent
Leek

(10) Patent No.: US 7,110,500 B2
(45) Date of Patent: Sep. 19, 2006

(54) MULTIPLE ENERGY X-RAY SOURCE AND INSPECTION APPARATUS EMPLOYING SAME

(76) Inventor: Paul H. Leek, 70 Acorn Hill Rd., Woodbridge, CT (US) 06525

( * ) Notice: Subject to any disclaimer, the term of this patent is extended or adjusted under 35 U.S.C. 154(b) by 15 days.

(21) Appl. No.: 10/936,950

(22) Filed: Sep. 8, 2004

(65) Prior Publication Data

US 2005/0078794 A1 Apr. 14, 2005

Related U.S. Application Data

(60) Provisional application No. 60/502,167, filed on Sep. 12, 2003, provisional application No. 60/502,901, filed on Sep. 15, 2003, provisional application No. 60/503,166, filed on Sep. 15, 2003.

(51) Int. Cl.
*H05G 1/32* (2006.01)

(52) U.S. Cl. ..... 378/111; 378/106; 378/119

(58) Field of Classification Search ..... 378/57, 378/106, 111, 112, 119, 101, 114, 121, 137, 378/138
See application file for complete search history.

(56) References Cited

U.S. PATENT DOCUMENTS

| | | | | |
|---|---|---|---|---|
| 4,361,901 | A * | 11/1982 | Daniels et al. | 378/106 |
| 4,988,919 | A | 1/1991 | Tanabe et al. | 315/5.41 |
| 5,044,002 | A * | 8/1991 | Stein | 378/54 |
| 5,046,078 | A | 9/1991 | Hernandez et al. | 378/119 |
| 5,418,372 | A | 5/1995 | Schonberg et al. | 250/492.3 |
| 5,434,420 | A | 7/1995 | McKeown et al. | 250/396 R |
| 5,493,596 | A | 2/1996 | Annis | 378/57 |
| 5,682,412 | A | 10/1997 | Skillicorn et al. | 378/98.6 |
| 5,798,579 | A | 8/1998 | McPhee | 307/106 |
| 5,811,943 | A | 9/1998 | Mishin et al. | 315/505 |
| 5,905,646 | A | 5/1999 | Crewson et al. | 363/132 |
| 6,005,912 | A | 12/1999 | Ocleppo | 378/57 |
| 6,066,901 | A | 5/2000 | Burkhart et al. | 307/106 |
| 6,111,931 | A | 8/2000 | Kusch | 378/106 |
| 6,553,049 | B1 | 4/2003 | Besaucele et al. | 372/57 |
| 6,649,914 | B1 | 11/2003 | Moorman et al. | 250/363.06 |
| 6,670,620 | B1 | 12/2003 | Okunuki | 250/492.2 |
| 6,744,060 | B1 | 6/2004 | Ness et al. | 250/504 R |
| 2003/0052612 | A1 | 3/2003 | Tanabe | 315/39 |

OTHER PUBLICATIONS

Bjorkholm, Paul J., "Dual Energy Detection of Weapons of Mass Destruction", Port Technology International, pp. 1-3, vol. PT22-6/4.

Shrivastava, P. et al., "Development of High Power Microwave Devices, Test facilities and Components for Accelerator Applications", CAT Newsletter, 1998, pp. 1-5, Year 11, No. 1-2.

Tanabe, E. et al., "Medical Applications of C-Band Accelerator Technology", Linac98—Papers, 1998, pp. 627-629, vol. TU4096.

U.S. Congress, Office of Technology Assessment, "Technology Against Terrorism: Structuring Security", OTA-ISC-511, Jan. 1992, pp. 60-62, (Washington, DC: U.S. Government Printing Office).

* cited by examiner

*Primary Examiner*—Courtney Thomas
(74) *Attorney, Agent, or Firm*—Holland & Bonzagni, P.C.; Mary R. Bonzagni, Esq.

(57) ABSTRACT

A multiple energy x-ray source capable of rapidly generating and delivering x-rays in the form of successive pulses that alternate between at least two different energy levels, as well as a multiple energy x-ray inspection apparatus for inspecting moving objects that employs such a multiple energy x-ray source, are provided. The inventive x-ray source facilitates the use of differential absorption characteristics as a means for distinguishing materials contained within objects during a moving inspection.

24 Claims, 4 Drawing Sheets

Modulator with Capacitor Charging Power Supply

Modulator With Inductive Charging And De Q Control

Modulator with Capacitor Charging Power Supply

Modulator With Inductive Charging And De Q Control

Triode gun

MULTIPLE ENERGY X-RAY SOURCE AND INSPECTION APPARATUS EMPLOYING SAME

RELATED APPLICATIONS

This application claims priority from U.S. Provisional Patent Application Ser. Nos. 60/502,167 (filed Sep. 12, 2003), 60/502,901 (filed Sep. 15, 2003), and 60/503,166 (filed Sep. 15, 2003), which are all hereby incorporated by reference.

FIELD OF THE INVENTION

The present invention relates generally to a multiple energy x-ray source capable of rapidly generating and delivering x-rays in the form of successive pulses that alternate between at least two different energy levels, and to a multiple energy x-ray inspection apparatus for inspecting moving objects that employs such a multiple energy x-ray source.

BACKGROUND AND SUMMARY OF THE INVENTION

X-ray inspection methods use x-rays to penetrate an object to reveal its contents. In the past, these methods have relied upon differential absorption ratios (i.e., the ratio of absorption by a material of x-rays of two different energies) to accentuate different materials inside an object. This technique is useful with a video or "real time" inspection. Two images can be taken and one image "subtracted" from the other, thereby accentuating the difference. This technique usually requires an operator to take a video exposure, store it, change the x-ray source energy, take another exposure, and subtract. This can take several seconds. If the subject is moving, the operator may miss some of the inspection. Alternatively, the object to be inspected can be scanned twice at different energies. This requires the object to be rescanned and the two scans to be aligned perfectly.

The drawbacks inherent in these prior art x-ray inspection methods or techniques are overcome by the present invention, which provides a method of changing the energy of x-rays produced by a pulsed x-ray source so that successive x-ray pulses alternate between at least two different energy levels. The pulsed x-ray source basically comprises: an electron accelerator structure defining an electron flow path having an electron injection end; an electron gun having an electron source, a control grid, and optionally a feedback resistor connected to the electron source, wherein the electron gun is located at the injection end of the electron accelerator structure; and a microwave system connected to the electron accelerator structure, which includes a microwave power source and a pulse generator with a pulse-forming network, while the inventive method comprises:

selecting at least two different voltage levels; and between pulses generated by the pulsed x-ray source, alternating the voltage applied or delivered to the pulse-forming network of the pulse generator between the selected voltage levels; and (i) alternating the voltage applied or delivered to the control grid of the electron gun between the selected voltage levels, and/or (ii) selecting at least two different resistance levels; and between pulses generated by the pulsed x-ray source, alternating the resistance through a feedback resistor on the electron gun between the selected resistance levels.

The present invention also provides a multiple energy x-ray source capable of rapidly generating and delivering x-rays in the form of successive pulses that alternate between at least two different energy levels, which comprises:

(a) an electron accelerator structure defining an electron flow path having an electron injection end;

(b) an electron gun having an electron source and a control grid and optionally a feedback resistor connected to the electron source, wherein the electron gun is located at the injection end of the electron accelerator structure for producing and delivering a stream of electrons to the electron injection end of the accelerator structure during pulses of predetermined length and of predetermined repetition rates;

(c) a microwave system connected to the electron accelerator structure that comprises: (i) a microwave power source; and (ii) a pulse generator with a pulse-forming network that is connected to the microwave power source;

(d) means for alternating the voltage applied or delivered to the pulse-forming network of the pulse generator between at least two different voltage levels; and (e) means for alternating the voltage applied or delivered to the control grid of the electron gun, between at least two different voltage levels, and/or means for alternating the resistance through a feedback resistor on the electron gun between at least two different resistance levels.

Further to the above, a method for inspecting moving objects is provided, which comprises:

(a) generating successive pulses of x-rays which alternate between at least a first and a second energy level, thereby forming a pulsed, multiple energy, x-ray beam;

(b) directing the pulsed, multiple energy, x-ray beam toward a moving object to be inspected;

(c) intercepting the pulsed, multiple energy, x-ray beam leaving the object and generating at least a first and a second signal or image therefrom; and (d) processing the at least first and second signals or images generated for each inspected object, thereby allowing or permitting detection of different materials present therein.

Also provided by way of the present invention is a multiple energy x-ray inspection apparatus for inspecting moving objects, which comprises:

(a) transport means for transporting objects for inspection through the apparatus;

(b) a multiple energy x-ray source for: generating successive pulses of x-rays which alternate between at least a first and a second energy level, thereby forming a pulsed, multiple energy, x-ray beam; and for directing same toward each object for inspection;

(c) sensor means for intercepting the pulsed, multiple energy, x-ray beam leaving each object and generating at least a first and a second signal or image therefrom; and (d) processing means for processing the at least first and second signals or images generated for each inspected object (e.g., subtracting the signals or images to accentuate absorption differences), thereby allowing or permitting detection of different materials present therein.

Other features and advantages of the invention will be apparent to one of ordinary skill from the following detailed description and drawings. Unless otherwise defined, all technical and scientific terms used herein have the same meaning as commonly understood by one of ordinary skill in the art to which this invention belongs. All publications, patent applications, patents and other references mentioned herein are incorporated by reference in their entirety. In case of conflict, the present specification, including definitions, will control. In addition, the materials, methods, and examples are illustrative only and not intended to be limiting.

BEST MODE FOR CARRYING OUT THE INVENTION

Figure 1:
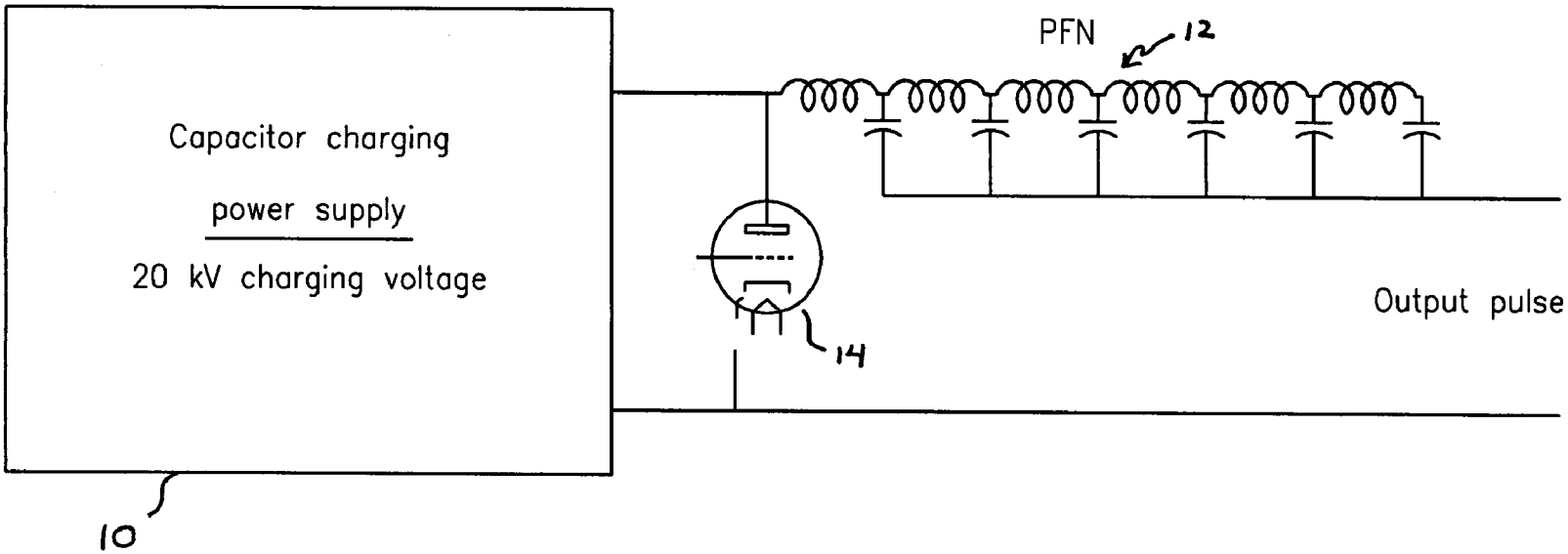
FIG. 1 is a simplified schematic diagram of a representative example of the means for alternating the voltage applied or delivered to the pulse-forming network of the pulse generator, between selected voltage levels.

The multiple energy x-ray source of the present invention is capable of rapidly generating and delivering x-rays in the form of successive pulses that alternate between at least two different energy levels. In a preferred embodiment, the pulses alternate between at least two different energy levels, and in a more preferred embodiment, the pulses alternate between a first energy level ranging from about 2 to about 6 Megavolts (MeV) (more preferably, 4 MeV), and a second energy level ranging from about 7 to about 11 MeV (more preferably, 8 MeV). The pulse duration ranges from about 1.5 to about 5 microseconds (μs), while pulse repetition frequency ranges from about 25 to about 1000 pulses per second.

Continuous and pulsed x-ray sources for use in x-ray inspection systems are known and typically comprise:

(a) an electron accelerator structure defining an electron flow path and having an electron injection end;

(b) an electron gun located at the injection end of the electron accelerator structure; and (c) a microwave power source that is connected to the electron accelerator structure.

In these prior art x-ray sources, the energy emitted from the accelerator structure is determined by three parameters, namely, the intensity of the electron beam generated by the electron gun, the length of the accelerator structure, and the amount of microwave power. By way of the present invention, and in particular regard to pulsed x-ray sources, it has been discovered that by changing the electron gun current and/or the microwave power level between pulses, the intensity of the electron beam or x-rays leaving the accelerator can be changed significantly and on a pulse-to-pulse basis.

In accordance with this discovery, the pulsed x-ray source of the present invention comprises:

(a) an electron accelerator structure defining an electron flow path and having an electron injection end;

(b) an electron gun having an electron source and a control grid and optionally a feedback resistor connected to the electron source, wherein the electron gun is located at the injection end of the electron accelerator structure and produces and delivers a stream of electrons to the electron injection end of the accelerator structure during pulses of predetermined length and of predetermined repetition rates;

(c) a microwave system connected to the electron accelerator structure that comprises: (i) a microwave power source; and (ii) a pulse generator with a pulse-forming network that is connected to the microwave power source;

(d) means for alternating the voltage applied or delivered to the pulse-forming network of the pulse generator between at least two different voltage levels; and (e) means for alternating the voltage applied or delivered to the control grid of the electron gun, between at least two different voltage levels, and/or means for alternating the resistance through a feedback resistor on the electron gun between at least two different resistance levels.

The electron accelerator structure of the pulsed x-ray source of the present invention is known and, in one embodiment, is an elongate accelerator structure that defines a linear electron flow path. Such an accelerator structure is generally made up of two basic sections, namely, a coupler section, and an accelerator section. The coupler section is a device that serves to transmit microwave power into the accelerator section. The accelerator section is composed of a series of identical cavities in which the transmitted microwave power is used to accelerate an electron beam. The cavities are brazed together to establish good electrical contact for the flow of microwave current and to provide an ultra-high vacuum seal.

Microwave power is transmitted to the accelerator section through the coupler section by means of a microwave system that, in a preferred embodiment, supplies microwave power in a peak power range of from about 0.5 to about 7 megawatts (MW) and in an average power range of from about 0.5 to about 5 kilowatts (kW). The microwave power is supplied in the form of pulses. In a preferred embodiment, the pulses alternate between at least two different energy levels, and in a more preferred embodiment, the pulses alternate between a first energy level ranging from about 0.5 to about 2.0 MW, and a second energy level ranging from about 2.0 to about 7.0 MW. The pulse duration ranges from about 1.5 to about 5 μs, while pulse repetition frequency ranges from about 25 to about 1000 pulses per second.

The microwave system is made up of a microwave power source (e.g., a high power tube like klystron or magnetron), a high power pulse generator (e.g., a "soft-tube" line type modulator) to energize the microwave power source or tube, and a waveguide line for transmitting the high output power from the power source or tube to the coupler or directly to the accelerator section. The pulse generator is generally made up of a power supply, a pulse forming network (PFN), a high voltage switch such as a hydrogen thyratron tube, and a pulse transformer.

By way of the present invention, it has been discovered that by changing the voltage applied to the PFN between pulses generated by the microwave power source, a rapid, pulse-to-pulse change in the energy of the x-rays emanating from the accelerator will result.

In one embodiment contemplated by way of the present invention, a power supply capable of changing the voltage supplied to the PFN between pulses is employed with the pulse generator. In a preferred embodiment, and as best shown in FIG. 1, a capacitor charging power supply 10 is used. Capacitor charging power supply 10 charges capacitors in PFN 12 to a voltage level commanded by a control board (not shown), while high voltage switching device 14 (e.g., thyratron, SCR) is off. Once the PFN 12 is charged up to a first voltage level (as commanded by the control board), switching device 14 is switched on, and will stay on until the anode current drops to zero. Device 14 will then switch off and power supply 10 will charge capacitors in the PFN 12 to a second voltage (as commanded by the control board). As will be readily evident to those skilled in the art, by programming the power supply 10 to alternate the voltage charged to the PFN 12 between pulses generated by device 14, the accelerator energy is changed from pulse to pulse.

A suitable capacitor charging power supply 10 has a 230 volt AC input and a 20 kilovolt (kV) output and is available from Spellman High Voltage Corporation, 475 Wireless Blvd., Hauppauge, N.Y., USA ("Spellman"), under the trade designation, capacitor charging high voltage power supply.

Figure 2:
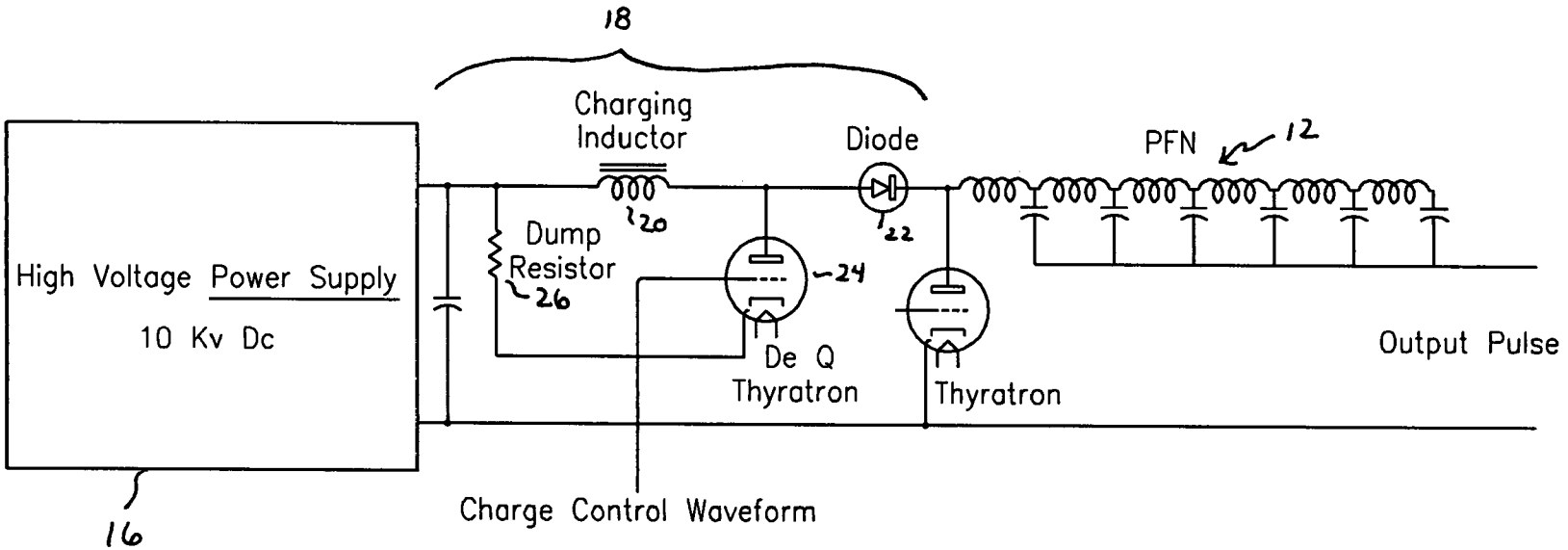
FIG. 2 is a simplified schematic diagram of another representative example of the means for alternating the voltage applied or delivered to the pulse-forming network, between selected voltage levels.

In another embodiment contemplated by way of the present invention, a fixed power supply and a resonant charger unit are employed with the pulse generator. In a preferred embodiment, and as best shown in FIG. 2, a dc power supply 16 and a resonant charger unit 18 are used to change the voltage supplied to the PFN 12 between pulses. The dc power supply 16 provides power for resonant charger unit 18. More specifically, the dc power supply 16 charges capacitors in the PFN 12 through a charging inductor 20, with the PFN 12 and the charging inductor 20 forming a resonant circuit. As current flows into the PFN 12, the magnetic field in charging inductor 20 increases. When the voltage across the PFN 12 reaches the same voltage as that coming from the power supply 16, the energy in the magnetic field of charging inductor 20 continues the charging process. The charging process stops when all of the energy in charging inductor 20 has passed into the PFN 12. At this point, the current is zero and the voltage on the PFN 12 is potentially twice the power supply voltage.

In order to control the end voltage on the PFN 12, a diode 22 and a de Qing switch (e.g., a hydrogen thyratron tube) 24 across a charging conductor, are triggered. This places dump resistor 26 across charging inductor 20. As a result, the Q of the resonant circuit is lowered and a majority of the remaining energy in the magnetic field of charging inductor 20 is dumped into resistor 26, thereby stopping any further current in charging inductor 20 from continuing to charge the PFN 12. This cycle provides very fine regulation of the voltage on the PFN 12 for each individual pulse.

The voltage supplied or charged to the PFN 12 is controlled by a de Qing comparator, which looks at a sample of the charging waveform, and when this reaches a set or reference dc voltage, triggers de Qing switch 24. By alternating the dc reference voltage between at least two different voltage levels on a pulse-to-pulse basis, the charging voltage on the PFN 12 can be changed from one pulse to another. A square wave is effectively superimposed on a DC voltage, forming two reference levels for the de Qing comparator.

A suitable dc power supply 16 is a 230 volt AC input, 10 kV output, regulated or unregulated, high voltage power supply and is available from Spellman under the trade designation, high voltage dc power supply.

Figure 3:
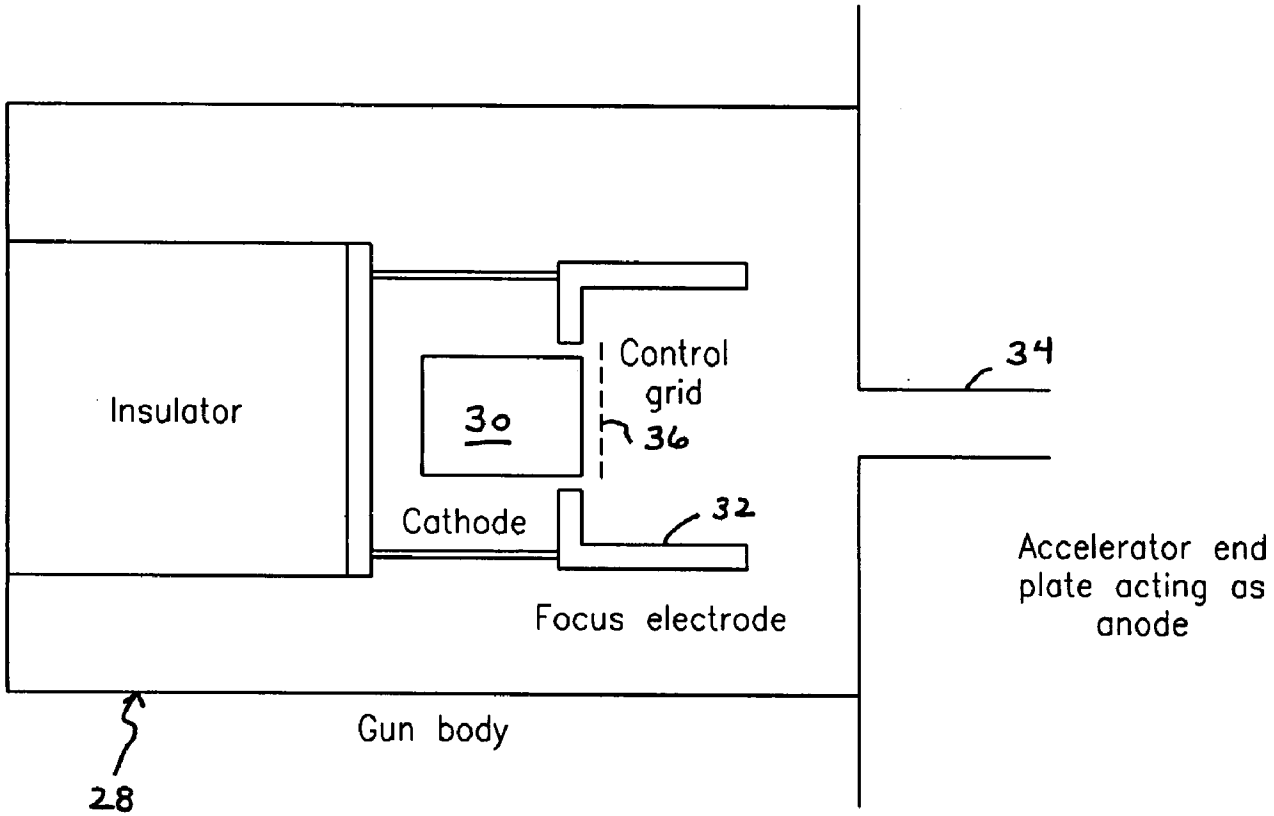
FIG. 3 is a simplified schematic diagram of a representative example of the electron gun of the pulsed x-ray source of the present invention.

Referring now to FIG. 3, a representative example of the electron gun of the inventive pulsed x-ray source is shown generally at 28. The electron gun 28 is basically a triode gun that produces a pulsed electron beam and comprises an electron source (e.g., cathode) 30, a focus electrode 32, an accelerating electrode 34, and a control grid 36 placed between the electron source 30 and accelerating electrode 34, to control the flow of electrons through the gun body. By way of the present invention, it has been discovered that rapid, pulse-to-pulse changes in the intensity of the electron beam emanating from gun 28 can be effected by injecting a voltage pulse into control grid 36, or by alternating the resistance of a line leading to cathode 30.

Figure 4:
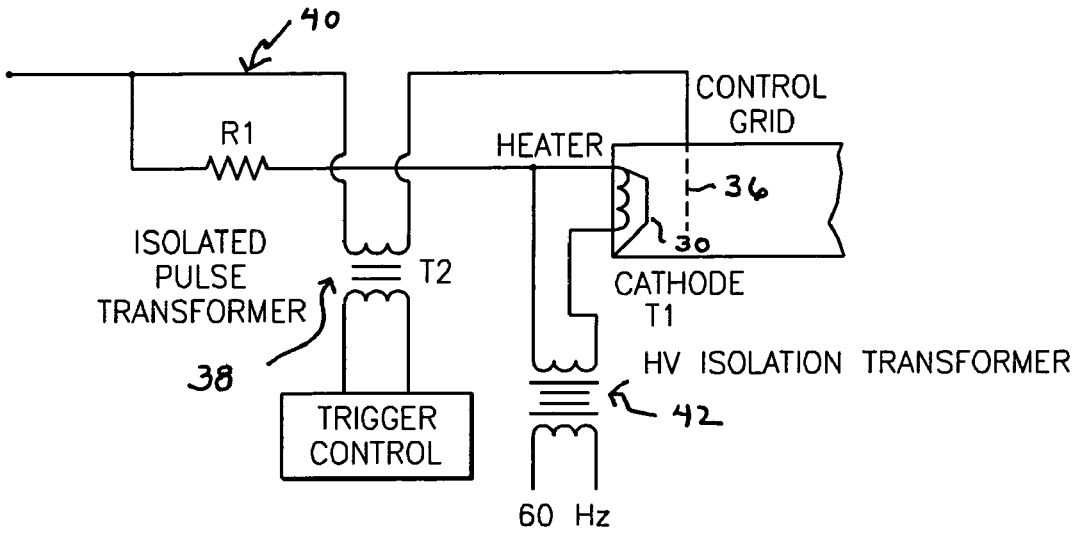
FIG. 4 is a simplified circuit diagram showing a means for alternating the voltage applied or delivered to the control grid of the electron gun between at least two different voltage levels.

In one such embodiment, which is best shown in FIG. 4, the intensity of the electron beam emanating from gun 28 is alternated between two different energy levels using a high voltage isolated pulse transformer 38 and a feedback resistor 40, which is placed in series with cathode 30 of electron gun 28. The pulse transformer 38 has a relatively high output voltage (i.e., several tens of volts) and is used in conjunction with a control circuit (not shown), which serves to alternate the voltage applied through the pulse transformer 38 to the control grid 36. In this embodiment, cathode 30 is heated by an internal heater, which is fed by isolation transformer 42, and feedback resistor 40 is used to stabilize the emitted current.

Figure 5:
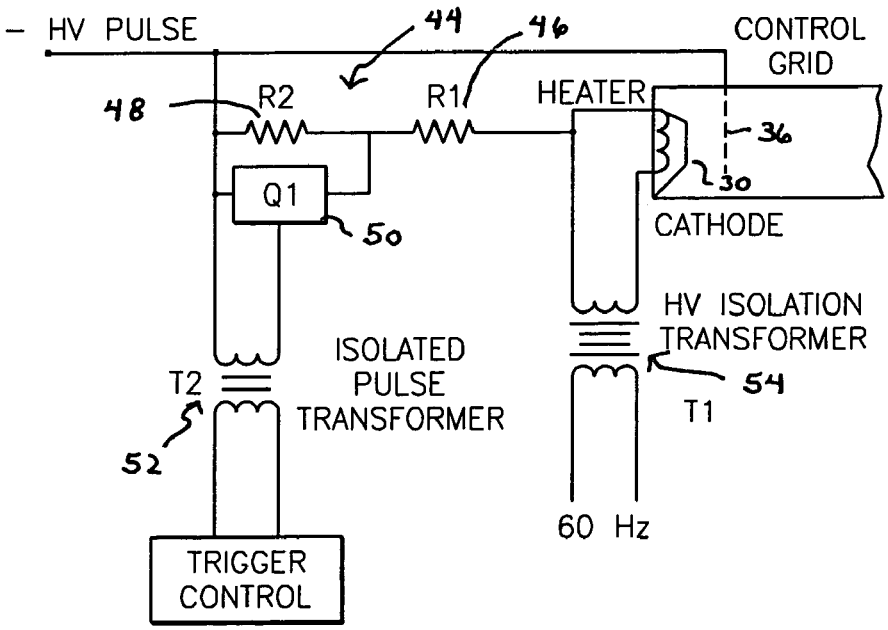
FIG. 5 is a simplified circuit diagram showing a means for alternating the resistance through a feedback resistor on the electron gun between at least two different resistance levels.

In a preferred embodiment, which is best shown in FIG. 5, a feedback resistor 44 is made up of a first resistor 46 and a second resistor 48 and is placed in series with cathode 30. In this preferred embodiment, the first resistor 46 defines a high current, while both resistors 46, 48 define a low current. To change the intensity of the electron beam emanating from gun 28, the second resistor 48 is shorted out by switch 50, during every other pulse emanating from the electron accelerator structure. Switch 50 is turned on and off using pulse transformer 52 having a high voltage isolation so as to permit gun 28 to operate at high voltage levels ranging from about 20 to about 40 kV. Switch 50 is preferably a semiconductor, and more preferably is either a high voltage transistor or a thyristor. As above, cathode 30 is heated by an internal heater, which is fed by isolation transformer 54.

The pulse transformer 38, 52 shown in FIGS. 4 and 5, respectively, is preferably driven by a divider circuit from a pulse repetition frequency (PRF) generator.

In a more preferred embodiment, the feedback resistor 44 of electron gun 28 (as shown in FIG. 5), is alternated between a first resistance of from about 500 to about 1,000 ohms and a second resistance of from about 2,000 to about 5,000 ohms in a period of time ranging from about 1 to about 2 μs, which results in an electron beam current that emanates from gun 28 that alternates between a first energy level of from about 500 to about 600 milliamps (ma) and a second energy level of from about 100 to from about 150 ma. The pulse duration ranges from about 2 to about 5 μs, while pulse repetition frequency ranges from about 25 to about 250 pulses per second.

As evident from the above detailed description, the method embodied within the inventive pulsed x-ray source for effecting a change in the energy of x-rays produced thereby so that successive x-ray pulses alternate between at least two different energy levels, basically comprises:

selecting at least two different voltage levels; and between pulses generated by the pulsed x-ray source, alternating the voltage applied or delivered to the pulse-forming network of the pulse generator between the selected voltage levels; and (i) alternating the voltage applied or delivered to the control grid of the electron gun between the selected voltage levels, and/or (ii) placing a feedback resistor in series with the cathode of the electron gun, selecting at least two different resistance levels; and between pulses generated by the pulsed x-ray source, alternating the resistance of the feedback resistor between the selected resistance levels.

The pulsed x-ray source of the present invention may be used in a multi- or dual energy x-ray inspection apparatus or system for inspecting the contents of moving objects. Such an apparatus or system uses radiographic means to discriminate the contents of these moving objects. More specifically, by irradiating the objects with x-rays alternating between at least two different energy levels and preferably alternating between two different energy levels, discrimination is possible where different materials have different attenuations at different x-ray energy levels.

The method for inspecting moving objects that is contemplated by the present invention basically comprises:

(a) generating successive pulses of x-rays which alternate between at least a first and a second energy level, thereby forming a pulsed, multiple energy, x-ray beam;

(b) directing the pulsed, multiple energy, x-ray beam toward a moving object to be inspected;

(c) intercepting the pulsed, multiple energy, x-ray beam leaving the object and generating at least a first and a second signal or image therefrom; and (d) processing the at least first and second signals or images generated for each inspected object, thereby allowing or permitting detection of different materials present therein.

The inventive method is embodied within the multiple energy x-ray inspection apparatus of the present invention, which basically comprises:

(a) transport means for transporting objects for inspection through the apparatus;

(b) a multiple energy x-ray source for: generating successive pulses of x-rays which alternate between at least a first and a second energy level, thereby forming a pulsed, multiple energy, x-ray beam; and for directing same toward each object for inspection;

(c) sensor means for intercepting the pulsed, multiple energy, x-ray beam leaving each object and generating at least a first and a second signal or image therefrom; and (d) processing means for processing the at least first and second signals or images generated for each inspected object (e.g., subtracting the signals or images to accentuate absorption differences), thereby allowing or permitting detection of different materials present therein.

The sensor means for intercepting the pulsed, multiple energy, x-ray beam leaving each object and generating at least a first and a second signal or image therefrom is not limited. In a preferred embodiment, the sensor means comprises a linear array of x-ray scintillator crystals, and diode photodetectors.

The processing means for processing the at least first and second signals or images generated for each inspected object comprises any method or technique for distinguishing materials based upon their absorption at different x-ray energy levels (e.g., distinguishing materials based upon their unique absorption ratio at two different x-ray energy levels). A common method or technique involves simple comparison, like image subtraction. Such a method or technique involves comparing the images at two or more energy levels and then using advanced computing techniques to analyze the images.

As mentioned above, using an x-ray source that is capable of generating pulses that "jump" from one energy level to another on a pulse to pulse basis allows an imaging system to take images at two different energy levels virtually simultaneously. Taking images using alternate pulses at high and low energies on the same scan ensures that the two images coincide spatially and temporally. It also allows an operator of such an imaging system to make only one pass, significantly increasing throughput.

While various embodiments of the present invention have been described above, it should be understood that they have been presented by way of example only, and not limitation. Thus, the breadth and scope of the present invention should not be limited by any of the exemplary embodiments.

The invention claimed is:

1. A method of rapidly changing the energy of x-rays produced by a pulsed x-ray source so that successive x-ray pulses alternate between at least two different energy levels, wherein the pulsed x-ray source produces x-rays at a rate of from about 25 to about 1000 pulses per second and includes (a) an electron linear accelerator structure defining an electron flow path having an electron injection end, (b) an electron gun having an electron source and a control grid and a feedback resistor placed in series with the electron source, wherein the electron gun is located at the injection end of the electron accelerator structure, and (c) a microwave system that is connected to the electron linear accelerator structure and that includes a microwave power source and a pulse generator with a pulse-forming network, wherein the method comprises:

selecting at least two different voltage levels; and between pulses generated by the pulsed x-ray source, alternating the voltage applied or delivered to the pulse-forming network of the pulse generator between the selected voltage levels; and (i) alternating the voltage applied or delivered to the control grid of the electron gun between the selected voltage levels, and/or (ii) selecting at least two different resistance levels; and between pulses generated by the pulsed x-ray source, alternating the resistance through the feedback resistor of a line leading to the electron source of the electron gun between the selected resistance levels.

2. The method of claim 1, wherein the feedback resistor comprises at least two resistors.

3. A multiple energy x-ray source capable of rapidly generating and delivering x-rays in the form of successive pulses that alternate between at least two different energy levels at a rate of from about 25 to about 1000 pulses per second, which comprises:

(a) an electron linear accelerator structure defining an electron flow path having an electron injection end;

(b) an electron gun having an electron source and a control grid and a feedback resistor placed in series with the electron source, wherein the electron gun is located at the injection end of the electron accelerator structure and produces and delivers a stream of electrons to the electron injection end of the accelerator structure during pulses of predetermined length and of predetermined repetition rates;

(c) a microwave system connected to the electron accelerator structure that comprises: (i) a microwave power source; and (ii) a pulse generator with a pulse-forming network that is connected to the microwave power source;

(d) means for alternating the voltage applied or delivered to the pulse-forming network of the pulse generator between at least two different voltage levels; and (e) means for alternating the voltage applied or delivered to the control grid of the electron gun, between at least two different voltage levels, and/or means for alternating the resistance through the feedback resistor of a line leading to the electron source of the electron gun between at least two different resistance levels.

4. The multiple energy x-ray source of claim 3, wherein the pulses generated and delivered by the x-ray source alternate between a first energy level ranging from about 2 to about 6 Megavolts, and a second energy level ranging from about 7 to about 11 Megavolts.

5. The multiple energy x-ray source of claim 4, wherein pulse duration ranges from about 1.5 to about 5 microseconds, and wherein pulse frequency ranges from about 25 to about 1000 pulses per second.

6. The multiple energy x-ray source of claim 3, wherein the means for alternating the voltage applied or delivered to the pulse-forming network of the pulse generator comprises a power supply capable of changing the voltage supplied to the pulse-forming network between pulses produced by the multiple energy x-ray source.

7. The multiple energy x-ray source of claim 6, wherein the means for alternating the voltage applied or delivered to the pulse-forming network of the pulse generator comprises a capacitor charging power supply.

8. The multiple energy x-ray source of claim 3, wherein the means for alternating the voltage applied or delivered to the pulse-forming network of the pulse generator comprises a fixed power supply and a resonant charger unit.

9. The multiple energy x-ray source of claim 3, wherein the means for alternating the voltage applied or delivered to the control grid of the electron gun comprises a high voltage isolated pulse transformer.

10. The multiple energy x-ray source of claim 3, wherein the electron gun has a feedback resistor connected to the electron source and wherein the means for alternating the resistance through the feedback resistor comprises a high voltage semiconductor switch.

11. The multiple energy x-ray source of claim 3, wherein the feedback resistor comprises at least two resistors.

12. A method for inspecting moving objects is provided, which comprises:

(a) generating successive pulses of x-rays which alternate between at least a first and a second energy level using a pulsed x-ray source that includes (i) an electron linear accelerator structure defining an electron flow path having an electron injection end, (ii) an electron gun having an electron source and a control grid and a feedback resistor placed in series with the electron source, wherein the electron gun is located at the injection end of the electron accelerator structure, and (iii) a microwave system that is connected to the electron linear accelerator structure and that includes a microwave power source and a pulse generator with a pulse-forming network, by:

selecting at least two different voltage levels; and between pulses generated by the pulsed x-ray source, alternating the voltage applied or delivered to the pulse-forming network of the pulse generator between the selected voltage levels; and (i) alternating the voltage applied or delivered to the control grid of the electron gun between the selected voltage levels, and/or (ii) selecting at least two different resistance levels; and between pulses generated by the pulsed x-ray source, alternating the resistance through the feedback resistor of a line leading to the electron source of the electron gun between the selected resistance levels;

(b) directing the pulsed, multiple energy, x-ray beam toward a moving object to be inspected;

(c) intercepting the pulsed, multiple energy, x-ray beam leaving the object and generating at least a first and a second signal or image therefrom; and (d) processing the at least first and second signals or images generated for each inspected object, thereby allowing or permitting detection of different materials present therein.

13. A multiple energy x-ray inspection apparatus for inspecting moving objects, which comprises:

(a) transport means for transporting objects for inspection through the apparatus;

(b) a multiple energy x-ray source for: generating successive pulses of x-rays which alternate between at least a first and a second energy level, thereby forming a pulsed, multiple energy, x-ray beam; and for directing same toward each object for inspection, wherein the multiple energy x-ray source comprises means for alternating the voltage applied or delivered to a pulse-forming network of a pulse generator of a microwave system between at least two different voltage levels; and means for alternating the voltage applied or delivered to a control grid of an electron gun between at least two different voltage levels, and/or means for alternating the resistance through a feedback resistor of a line leading to an electron source of an electron gun between at least two different resistance levels;

(c) sensor means for intercepting the pulsed, multiple energy, x-ray beam leaving each object and generating at least a first and a second signal or image therefrom; and (d) processing means for processing the at least first and second signals or images generated for each inspected object (e.g., subtracting the signals or images to accentuate absorption differences), thereby allowing or permitting detection of different materials present therein.

14. The multiple energy x-ray inspection apparatus of claim 13, wherein the multiple energy x-ray source further comprises:

(a) an electron linear accelerator structure defining an electron flow path having an electron injection end;

(b) an electron gun having an electron source and a control grid and a feedback resistor placed in series with the electron source, wherein the electron gun is located at the injection end of the electron accelerator structure and produces and delivers a stream of electrons to the electron injection end of the accelerator structure during pulses of predetermined length and of predetermined repetition rates; and (c) a microwave system connected to the electron accelerator structure that comprises: (i) a microwave power source; and (ii) a pulse generator with a pulse-forming network that is connected to the microwave power source.

15. The multiple energy x-ray inspection apparatus of claim 14, wherein the pulses generated and delivered by the x-ray source alternate between a first energy level ranging from about 2 to about 6 Megavolts, and a second energy level ranging from about 7 to about 11 Megavolts.

16. The multiple energy x-ray inspection apparatus of claim 15, wherein pulse duration ranges from about 1.5 to about 5 microseconds, and wherein pulse frequency ranges from about 25 to about 1000 pulses per second.

17. The multiple energy x-ray inspection apparatus of claim 13, wherein the means for alternating the voltage applied or delivered to a pulse-forming network of a pulse generator of a microwave system comprises a power supply capable of changing the voltage supplied to the pulse-forming network between pulses produced by the multiple energy x-ray source.

18. The multiple energy x-ray inspection apparatus of claim 17, wherein the means for alternating the voltage applied or delivered to a pulse-forming network of a pulse generator of a microwave system comprises a capacitor charging power supply.

19. The multiple energy x-ray inspection apparatus of claim 13, wherein the means for alternating the voltage applied or delivered to a pulse-forming network of a pulse generator of a microwave system comprises a fixed power supply and a resonant charger unit.

20. The multiple energy x-ray inspection apparatus of claim 13, wherein the means for alternating the voltage applied or delivered to a control grid of an electron gun comprises a high voltage isolated pulse transformer.

21. The multiple energy x-ray inspection apparatus of claim 14, wherein the electron gun has a feedback resistor placed in series with the electron source and wherein the means for alternating the resistance through the feedback resistor comprises a high voltage semiconductor switch.

22. A multiple energy x-ray source capable of rapidly generating and delivering x-rays in the form of successive pulses that alternate between at least two different energy levels, which comprises:

(a) an electron accelerator structure defining an electron flow path having an electron injection end;

(b) an electron gun having an electron source and a control grid, wherein the electron gun is located at the injection end of the electron accelerator structure and produces and delivers a stream of electrons to the electron injection end of the accelerator structure during pulses of predetermined length and of predetermined repetition rates;

(c) a microwave system connected to the electron accelerator structure that comprises: (i) a microwave power source; and (ii) a pulse generator with a pulse-forming network that is connected to the microwave power source;

(d) means for alternating the voltage applied or delivered to the pulse-forming network of the pulse generator between at least two different voltage levels; and (e) means for alternating the voltage applied or delivered to the control grid of the electron gun, between at least two different voltage levels.

23. A multiple energy x-ray source capable of rapidly generating and delivering x-rays in the form of successive pulses that alternate between at least two different energy levels at a rate of from about 25 to about 1000 pulses per second, which comprises:

(a) an electron linear accelerator structure defining an electron flow path having an electron injection end;

(b) an electron gun having an electron source and a control grid and a feedback resistor comprising at least two resistors placed in series with the electron source, wherein the electron gun is located at the injection end of the electron accelerator structure and produces and delivers a stream of electrons to the electron injection end of the accelerator structure during pulses of predetermined length and of predetermined repetition rates;

(c) a microwave system connected to the electron accelerator structure that comprises: (i) a microwave power source; and (ii) a pulse generator with a pulse-forming network that is connected to the microwave power source;

(d) means for alternating the voltage applied or delivered to the pulse-forming network of the pulse generator between at least two different voltage levels; and (e) means for alternating the resistance through the feedback resistor of a line leading to the electron source of the electron gun between at least two different resistance levels.

24. A multiple energy x-ray source capable of rapidly generating and delivering x-rays in the form of successive pulses that alternate between at least two different energy levels, which comprises:

(a) an electron accelerator structure defining an electron flow path having an electron injection end;

(b) an electron gun having an electron source and a control grid and a feedback resistor placed in series with the electron source, wherein the electron gun is located at the injection end of the electron accelerator structure and produces and delivers a stream of electrons to the electron injection end of the accelerator structure during pulses of predetermined length and of predetermined repetition rates;

(c) a microwave system connected to the electron accelerator structure that comprises: (i) a microwave power source; and (ii) a pulse generator with a pulse-forming network that is connected to the microwave power source;

(d) means for alternating the voltage applied or delivered to the pulse-forming network of the pulse generator between at least two different voltage levels;

(e) means for alternating the voltage applied or delivered to the control grid of the electron gun, between at least two different voltage levels; and (f) means for alternating the resistance through the feedback resistor of a line leading to the electron source of the electron gun between at least two different resistance levels.

* * * * *